US007540526B2

(12) United States Patent
Himmetsberger et al.

(10) Patent No.: US 7,540,526 B2
(45) Date of Patent: Jun. 2, 2009

(54) SLIDING BOARD

(75) Inventors: Alois Himmetsberger, Vienna (AT); Manfred Baumgartner, Lichtenwörth (AT); Gernot Jahnel, Katzelsdorf (AT)

(73) Assignee: Tyrolia Technology GmbH (AT)

( * ) Notice: Subject to any disclaimer, the term of this patent is extended or adjusted under 35 U.S.C. 154(b) by 386 days.

(21) Appl. No.: 11/327,083

(22) Filed: Jan. 6, 2006

(65) Prior Publication Data

US 2007/0205582 A1 Sep. 6, 2007

(30) Foreign Application Priority Data

Jan. 7, 2005 (EP) ..... 05000228

(51) Int. Cl.
*A63C 5/04* (2006.01)

(52) U.S. Cl. ..... 280/609; 280/618

(58) Field of Classification Search ..... 280/601, 280/607, 609, 611, 617, 618
See application file for complete search history.

(56) References Cited

U.S. PATENT DOCUMENTS

| | | | | |
|---|---|---|---|---|
| 5,221,105 | A * | 6/1993 | Mayr et al. | 280/633 |
| 5,499,836 | A * | 3/1996 | Juhasz | 280/602 |
| 5,871,223 | A * | 2/1999 | Zanco | 280/607 |
| 5,915,719 | A * | 6/1999 | Bauvois | 280/607 |
| 6,217,055 | B1 * | 4/2001 | Silva | 280/607 |
| 6,786,502 | B2 * | 9/2004 | Carlson | 280/633 |
| 7,011,331 | B2 * | 3/2006 | Riepler | 280/601 |

FOREIGN PATENT DOCUMENTS

| | | |
|---|---|---|
| DE | 79 05 336 | 8/1980 |
| DE | 20 2004 001 356.8 | 5/2005 |
| EP | 0 758 557 A2 | 2/1997 |
| EP | 1 329 243 A | 7/2003 |
| FR | 2 634 659 A | 2/1990 |
| WO | WO 02/49728 A1 | 6/2002 |

* cited by examiner

*Primary Examiner*—Christopher P Ellis
*Assistant Examiner*—Brian Swenson
(74) *Attorney, Agent, or Firm*—Ostrolenk, Faber, Gerb & Soffen, LLP

(57) ABSTRACT

The invention relates to a sliding board, in particular a ski, which is provided in its central portion with at least one receiving part which is arranged in a recessed fashion in relation to its upper side and is intended for slidably movable arrangement of a binding part, a binding or a supporting part of the binding part or binding which can be fixed in defined positions in the longitudinal direction of the sliding board.

The receiving part (3, 3', 3'', 3''') is incorporated in the ski in such a way that it functionally replaces the core of the ski, and if appropriate reinforcing plies, at least partially.

15 Claims, 2 Drawing Sheets

SLIDING BOARD

The invention relates to a sliding board, in particular a ski, which is provided in its central portion with at least one receiving part which is arranged in a recessed fashion in relation to its upper side and is intended for slidably movable arrangement of a binding part, a binding or a supporting part of the binding part or binding which can be fixed in defined positions in the longitudinal direction of the sliding board.

The invention also relates to a mold with a mold upper part and a mold lower part for pressing together the sliding board constructed from its components—a running coating, a covering layer, if appropriate further reinforcing plies and if appropriate a one-part or multi-part core.

A ski, or a board for sliding on snow, of the kind mentioned in the introduction with a ski binding receiver or guide rail arrangement for binding units which is arranged in a let-in or recessed fashion is known from WO 03/039687 A2. The guide rail arrangement consisting of a base layer and guide rails formed thereon is laminated onto the upper structural layer of the ski. The upper side of the ski is formed subsequently by a laminated-on covering layer which covers the guide rail arrangement and, for creating the necessary window, is opened, in particular punched out, in the region of the guide rail arrangement. The guide rail arrangement is therefore located above an upper structural layer, under tensile load, of the ski. The components bringing about the flexural strength and torsional strength of the ski remain unaffected by the guide rail arrangement and are made in the conventional way. The guide rail arrangement limited to the central portion of the ski enlarges the ski cross section and also increases the weight of the ski. During production of the ski, slide parts are inserted displaceably into the guide rail arrangement, on which the ski binding parts are to be mounted when the ski is finished.

A method for production of a ski in a pressing mold comprising a mold upper part and a mold lower part, in which elements for arranging or fastening the ski binding or ski binding parts are inserted into at least one of the reinforcing plies and into the outer covering layer during construction of the ski, is known from EP 1 329 243 A1. When the pressing mold is closed, at least those abutting regions between the elements and the surface film or the covering layer extending in the longitudinal direction of the ski are subjected to pressing force and the elements are in this way integrated into the ski construction. In this embodiment as well, the guide rail arrangement is located on the outer side of the otherwise conventionally constructed ski.

The invention is based on the object of, in a board for sliding on snow, in particular an alpine ski, incorporating the receiving part, arranged in a recessed fashion in relation to the upper side of the ski, for binding units, their supporting plates or other components in an alternative way which leaves the ski cross section and the weight of the ski largely unaffected.

A mold which makes easy handling and optimum pressing-together possible is to be provided for the sliding board or ski.

According to the invention, the object set is achieved by virtue of the fact that the receiving part is incorporated in the ski in such a way that it functionally replaces the core of the ski, and if appropriate reinforcing plies, at least partially.

According to the invention, the binding receiving part therefore forms a functional component of the ski which replaces the core completely or at least in part and can consequently have considerable influence on functions and characteristics of the ski, for example the flexural strength and the torsional strength.

In a preferred embodiment of the invention, the receiving part occupies at least in part or replaces that space in the ski interior which would be occupied by the core or by core components. The invention therefore transfers core functions to the receiving part in such a way that the sliding board or ski can be produced in a compact and weight-saving way.

It is to be possible on the finished sliding board or ski to position the binding or ski binding or ski binding parts in the receiving part in an easy way. The receiving part therefore comprises in particular groove-like guides, formed below guide portions, for the insertion of guide projections of the binding, of the binding part or of the supporting part. Insertion of the binding is especially easy via one or more insertion openings which can be formed by the receiving part being made free from guide portions over part of its longitudinal extent.

In order to reduce finishing work as much as possible on the finished ski, it is advantageous if the outer covering layer has already been cut out in such a way during construction of the sliding board that it at least covers the guide portions but at the same time in particular does not project in the direction of the cutout.

The invention permits various arrangements of the guides for the binding or binding parts. In this connection, an embodiment is preferred in which the receiving part is essentially C-shaped in cross section and the guides are arranged in such a way that they are closed in the direction of the two ski sides. A further preferred alternative consists in providing the receiving part with a central part on which the guides are arranged in such a way that they are closed in the direction of the ski center.

The receiving part can be integrated in various ways during production of the sliding board. In a preferred possibility, the receiving part is integrated at least partially by foamed material which hardens during the pressing operation of the sliding board. This kind of integration can be especially durable in particular when the receiving part is provided with anchoring parts which are retained in the hardened foamed material. In this variant, liquid foamed material, which forms the usual foamed material core in the sliding board parts outside the receiving part, is therefore introduced at the beginning of the pressing operation.

In a further variant of the invention, the receiving part can be inserted into a milled-out or cut-out recess of a foamed material part, foamed material block or the like and connected, in particular bonded, thereto. In this variant as well, it is possible to form or mold the core from this foamed material part or foamed material block outside the binding mounting region of the sliding board or ski.

An embodiment is also possible in which the receiving part is connected, in particular bonded, to a number of residual core components, for example two side parts and a further component, arranged below the base of the receiving part, made of wood or plastic.

In a further variant embodiment of the invention, the receiving part can be made in one piece with the sliding board side parts or side cheeks covered by the outer covering layer.

It may also be advantageous for handling of the sliding board parts during assembly if the receiving part is of multi-part design, so that a number of receiving parts, which preferably adjoin one another directly, are then included in the finished sliding board.

The dimensions of the components of the receiving part, in particular their material thickness, and also the selection of the material influence the flexural and torsional strength of the sliding board. It is consequently possible to influence various characteristics in a desired way by, for example, variation of the material thicknesses of the receiving part in the longitudinal and/or transverse direction of the sliding board.

As already mentioned, it is also possible to influence the sliding board characteristics accordingly via the selection of the material. In addition to plastics, above all composite materials or fiber-reinforced plastics are possible for the receiving part.

In the case of a receiving part which is essentially C-shaped in cross section, the pressing operation can be carried out in an easy way with a pressing mold made according to the invention which comprises a mold upper part and a mold lower part. To this end, the mold upper part is provided with at least one projection which presses on the receiving part between the guide portions when the mold is closed. The side walls of the projection can then seal the end sides of the covering layer and of the guide portions when the mold is closed.

Further features, advantages and details of the invention are described in greater detail with reference to the diagrammatic drawing, which shows a number of illustrative embodiments and in which.

Figure 1:
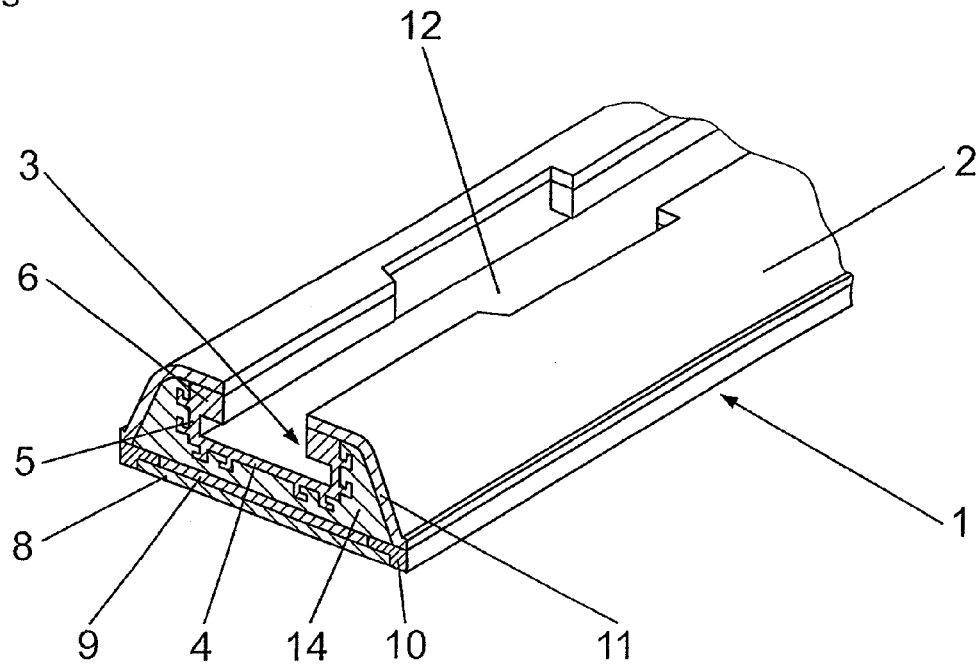
FIG. 1 shows a view at an angle of the central portion of an embodiment of a ski made according to the invention.

Common components of the variant embodiments of a ski 1 shown in all the figures are a running coating 8, a lower skin 9 adjacent thereto and made, for example, from a metal alloy, steel edges 10 and a covering layer 11, or upper shell or cap, which serves as impact protection and design carrier.

In all the variant embodiments, additional plies, for instance glass-fiber reinforcing plies, metal reinforcing plies, prepreg plies and the like, can be introduced between the plies 8, 9 and 11 illustrated and the core, which will be explained further.

Figure 2:
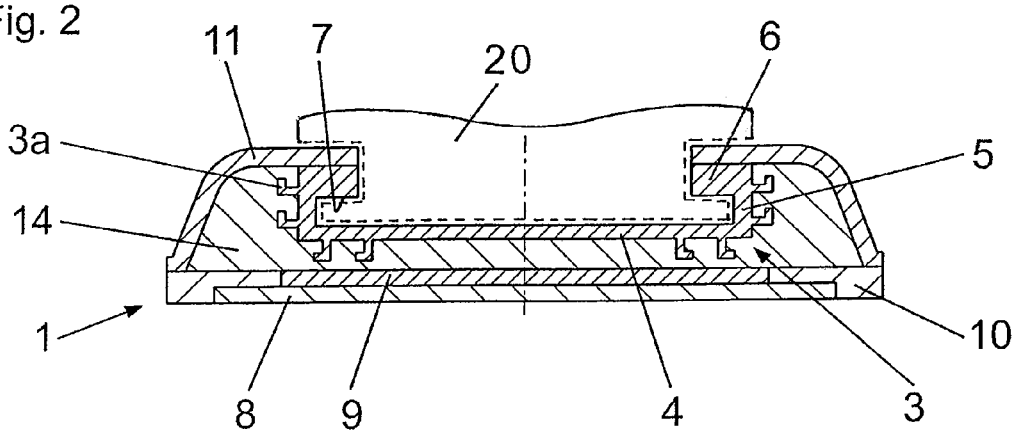
FIGS. 2 to 5 show cross sections through different embodiments of skis made according to the invention.

FIG. 1 shows a view at an angle of the central portion 2 of an embodiment of a ski 1, which is illustrated in cross section in FIG. 2. A ski binding, which consists in particular of two ski binding parts, shown at 20 in FIG. 2, a front jaw and a heel holder, is arranged and fixed in the central portion 2 of the ski 1. The arrangement and fastening of the ski binding or ski binding parts is effected in and on a receiving part 3 which is incorporated in the ski 1, is a functional component of the ski 1 and at least co-influences the characteristics of the ski 1, in particular the torsional strength and the flexural strength. In the embodiment shown in FIG. 1, the receiving part 3 is made in one piece, but it can also be composed of a number of parts over its extent in the longitudinal direction of the ski. The receiving part 3 is preferably a plastic part produced by injection-molding.

As FIG. 1 and FIG. 2 show, the receiving part 3 which is essentially C-shaped in cross section consists of a plate-shaped base 4 which extends parallel to the running coating 8 and is followed on its sides extending in the longitudinal direction of the ski by portions 5 which point in the direction of the upper side of the ski and at their upper ends become short guide portions 6 pointing in the direction of the ski center. In this way, two groove-like guides 7, which extend in the longitudinal direction of the ski and in which correspondingly designed guide projections of ski binding parts—base plates, mounting plates and supporting plates—can be arranged slidably displaceably, are formed below the guide portions 6. The guides 7 retain the ski binding or ski binding parts on the ski 1 in the vertical direction and in the transverse direction. Insertion of the ski binding or ski binding part can take place through an insertion opening 12 shown in FIG. 1, which is formed on the receiving part 3 by omitting the two guide portions 6 over a certain longitudinal extent, so that the ski binding or ski binding part can be inserted and guided into the receiving part 3 from the upper side of the ski. To fix the ski binding parts or ski binding (not shown) in the longitudinal direction of the ski, these can be provided with catching devices which can be operated from outside and comprise catching parts, toothings etc. which engage in corresponding counter-catches (not shown) which can be ,designed on the receiving part 3. Provision can also be made for the ski binding parts inserted on each side of the opening 12 to be interconnected via a flexible metal band or the like and for this band to be connected to the base 4, for instance by screwing, centrally between the two ski binding parts, for example in the region of the insertion opening 12. The fixing of the ski binding or ski binding parts in the longitudinal direction of the ski on the receiving part 3 or ski 1 does not form the subject matter of the invention and is therefore not illustrated either.

The covering layer 11 is cut out centrally in the central portion 2 or in the region of extent of the receiving part 3 and only covers the guide portions 6 or in the region of the insertion opening 12 the lateral portions 5. The opening in the covering layer 11 is already made during its production, and the ski is therefore pressed with the cut-out covering layer 11.

In the embodiment shown in FIG. 1 and FIG. 2, that part 14 of the core remaining around the receiving part 3 is made from a foamed plastic material which is introduced into the ready-assembled ski 1 and hardens during the pressing operation. The receiving part 3 is in this way integrated by the hardening foamed material. The hardened foamed material can form the core of the ski 1 outside the central portion 2. In the region of the central portion 2, in that region therefore where the receiving part 3 is introduced, the foamed material fills the cavity between the covering layer 11, the steel edges 10 and the lower skin 9 on the one hand and the receiving part 3 on the other hand. Consequently, the receiving part 3 partially replaces the core and if appropriate further reinforcing plies, takes on its or their function at least in part and therefore also influences the flexural strength and the torsional strength of the ski 1. The wall thickness of the receiving part 3 can vary over its longitudinal and/or transverse extent depending on position in the ski so as, for example, to change the flexural strength and the torsional strength over the longitudinal extent of the ski.

Anchoring parts 3*a* which are hook-shaped in cross section and can also have any other cross-sectional shapes, for example pin-shaped or drop-shaped, and can be provided with indentations, grooves and the like, are formed on the receiving part 3 in order to support anchoring of the receiving part 3 in the hardening foam. The anchoring parts can also be elongate projections of the receiving part 3 which extend in the longitudinal direction of the ski.

As an alternative to foaming, provision can be made for a recess for inserting the receiving part 3 to be made in an already foamed core component by appropriate milling-out and/or cutting-out and for the receiving part 3 to be bonded in the foam block. No anchoring parts are necessary in this case.

Figure 3:
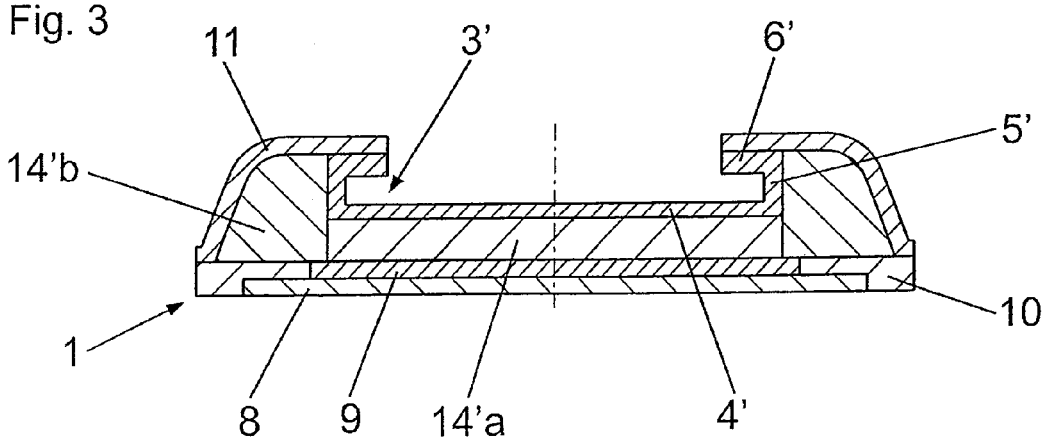

In the embodiment shown in FIG. 3, the receiving part 3' is essentially similar to the receiving part 3 in FIG. 2 but without anchoring parts and therefore comprises a base 4', portions 5' and guide portions 6'. A residual core part 14'*a*, made of wood for example, is incorporated below the base 4' of the receiving part 3', and separate side parts 14'*b*, which can be made of wood or plastic (foamed material), are incorporated laterally. The connection of the parts 14'*a*, 14'*b* to the receiving part 3' can be effected by bonding, by resin which hardens during pressing of the ski, by resin from prepreg plies or the like.

Figure 4:
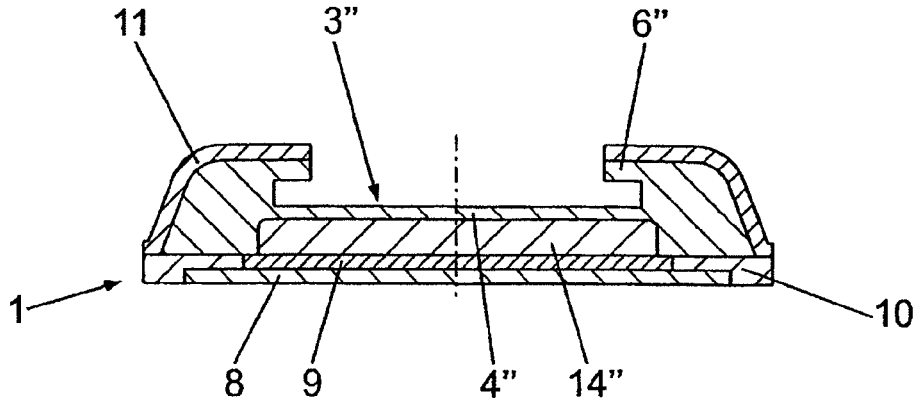

In the variant embodiment shown in FIG. 4, the receiving part 3" is made in one piece with the side cheeks of the ski 1 and is covered directly by the covering layer 11, in the region of the guide portions 6" as well. A residual core part 14" made of wood or plastic (foamed material) is located below the base 4" of the receiving part 3".

Figure 5:
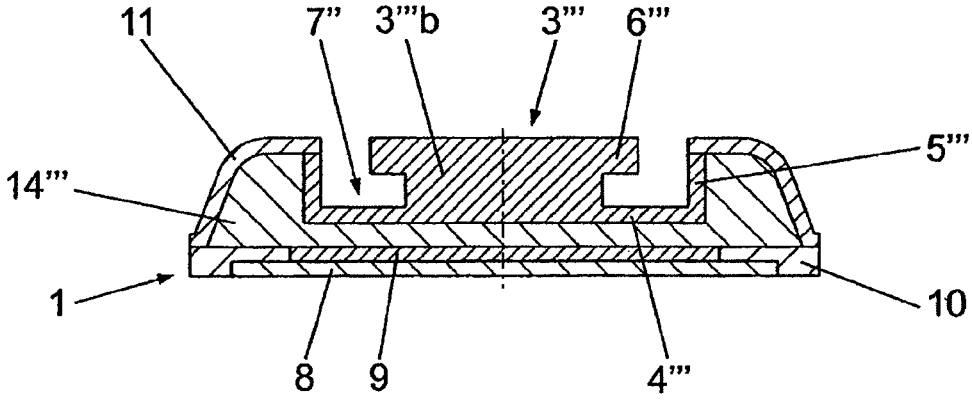

FIG. 5 shows an embodiment in which the two groove-like guides 7' for the slidably movable arrangement of the ski binding or ski binding parts are designed in a more solidly designed central part 3'''*b* of the receiving part 3''' and point toward the ski center. The receiving part 3''' comprises a base 4''' and lateral portions 5''', the guide portions 6''' are designed on the central part 3'''*b* and point toward the side edges of the ski. The space formed in the interior of the ski between the covering layer 11, the skin 9 and the receiving part 3''' can, as in the embodiment according to FIG. 1, be filled with liquid foamed material which hardens during the pressing operation of the ski or consist of residual core parts made of wood or foamed material. In this embodiment as well, an insertion opening can make insertion and pushing-in of the ski binding parts possible, the two guide portions 6''' being omitted in the region of the insertion opening.

Figure 6:
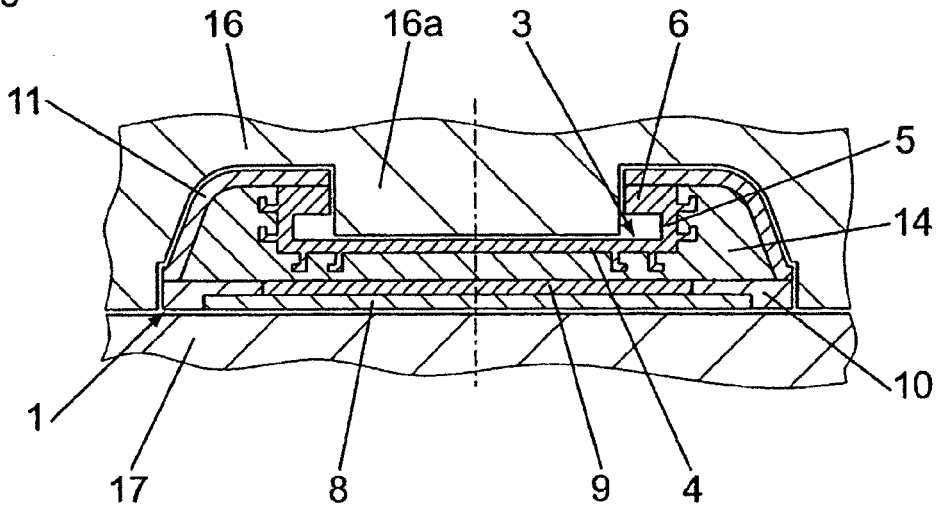
FIG. 6 shows a partial cross section through mold parts of a pressing mold during pressing of a ski made according to FIG. 1.

FIG. 6 shows a cross section through the ski 1 according to FIG. 2, introduced into a pressing mold, of which part regions of the mold upper part 16 and of the mold lower part 17 are illustrated. The mold upper part 16 is shaped according to the outer contour of the ski and comprises a projection 16*a* which, when the mold is closed, ensures that the covering layer 11 and the receiving part 3 are pressed on and also that the individual ski components are connected with appropriate pressure application and supply of heat. The projection of the mold upper part is made correspondingly wider in the region of the insertion opening.

In this connection, it is advantageous if the end sides of the guide portions 6 and of the covering layer 11 come into contact with the side surfaces of the projection 16*a*. Undercuts in these regions of the ski, which may interfere with the contact, are therefore to be avoided. The embodiment shown in FIG. 5 can be pressed together with a mold upper part without a projection.

A sealing mass can be introduced in the contact surface between the covering layer 11 and the guide portions 6 of the receiving part 3 in order to prevent undesirable escape of the foamed material which is at first still liquid.

The invention claimed is:

1. A sliding board, which is provided in its central portion with at least one receiving part which is arranged in a recessed fashion in relation to its upper side, for slidably movable arrangement of a binding part, a binding, or a supporting part of the binding part or binding, which can be fixed in defined positions in the longitudinal direction of the sliding board, wherein the receiving part is incorporated in a core region of the sliding board;

wherein the receiving part comprises in particular groove-like guides, formed below guide portions, for the insertion of guide projections of the binding, of the binding part or of the supporting part; and wherein the outer covering layer has been cut out centrally in such a way that it at least covers the guide portions.

2. The sliding board as claimed in claim 1, wherein the receiving part occupies at least in part that space in the sliding board which would otherwise be occupied by the core or by core components.

3. The sliding board as claimed in claim 1 wherein the receiving part is essentially C-shaped in cross section and the guides are arranged in such a way that they are closed in the direction of the two sliding board sides.

4. The sliding board as claimed in claim 1, wherein the receiving part comprises a central part on which the guides are arranged in such a way that they are closed in the direction of the sliding board center.

5. The sliding board as claimed in claim 1, wherein the receiving part is integrated in the sliding board interior at least partially by hardened foamed material.

6. The sliding board as claimed in claim 1, wherein the receiving part is inserted into a milled-out or cut-out recess of a foamed material part and connected, in particular bonded, thereto.

7. The sliding board as claimed in claim 1, wherein the receiving part is connected, in particular bonded, to residual core components made of wood and/or plastic.

8. The sliding board as claimed in claim 1, wherein the receiving part is made in one piece with the sliding board side parts or the sliding board side cheeks covered by the outer covering layer.

9. The sliding board as claimed in claim 1, wherein the receiving part is free from guide portions over part of its longitudinal extent.

10. The sliding board as claimed in claim 1, wherein a plurality of receiving parts are included.

11. The sliding board as claimed in claim 1, wherein the material cross section of the receiving part varies in the longitudinal and/or transverse direction of the sliding board according to desired flexural and torsional strength.

12. The sliding board as claimed in claim 1, wherein the receiving part is made from a plastic, a fiber-reinforced plastic or a composite material.

13. A pressing mold with a mold upper part and a mold lower part for pressing the sliding board as claimed in claim 1, wherein the mold upper part is provided with at least one projection which exerts pressure on the receiving part between the guide portions when the mold is closed.

14. The pressing mold as claimed in claim 13, wherein the side walls of the projection seal the end sides of the covering layer and of the guide portions when the mold is closed.

15. A sliding board, which is provided in its central portion with at least one receiving part which is arranged in a recessed fashion in relation to its upper side, for slidablv movable arrangement of a binding part, a binding, or a supporting part of the binding part or binding, which can be fixed in defined positions in the longitudinal direction of the sliding board, wherein the receiving part is incorporated in a core region of the sliding board;

wherein the receiving part is integrated in the sliding board interior at least partially by foamed material which hardens during the pressing operation of the sliding board;

wherein the receiving part comprises anchoring parts retained in the hardened foamed material.

* * * * *